United States Patent [19]

Humphrey

[11] Patent Number: 4,840,006

[45] Date of Patent: Jun. 20, 1989

[54] STRETCH WRAPPING MACHINE

[75] Inventor: John R. Humphrey, Naples, Fla.

[73] Assignee: International Packaging Machines, Inc., Naples, Fla.

[21] Appl. No.: 62,466

[22] Filed: Jun. 15, 1987

Related U.S. Application Data

[60] Division of Ser. No. 813,074, Dec. 24, 1985, Pat. No. 4,693,049, which is a continuation-in-part of Ser. No. 374,741, May 4, 1982, Pat. No. 4,590,746, which is a continuation-in-part of Ser. No. 307,283, Sep. 30, 1981, abandoned.

[51] Int. Cl.[4] ..... B65B 11/04

[52] U.S. Cl. ..... 53/64; 53/556; 53/587

[58] Field of Search ..... 53/556, 587, 389, 64; 242/75.45, 75.4, 75.47

[56] References Cited

U.S. PATENT DOCUMENTS

| | | | |
|---|---|---|---|
| 3,232,551 | 2/1966 | Rathmann | 242/75.45 |
| 3,243,138 | 3/1966 | Nilsson | 242/75.45 |
| 4,095,318 | 6/1978 | Abbott | 53/556 X |
| 4,458,467 | 7/1984 | Shulman | 53/556 |
| 4,514,955 | 5/1985 | Mouser | 53/556 |
| 4,590,746 | 5/1986 | Humphrey | 53/556 |

FOREIGN PATENT DOCUMENTS

| | | | |
|---|---|---|---|
| 144266 | 6/1985 | European Pat. Off. | 53/556 |
| 2750780 | 5/1979 | Fed. Rep. of Germany | 53/556 |
| 3140972 | 6/1982 | Fed. Rep. of Germany | 53/587 |
| 2059906 | 4/1981 | United Kingdom | 53/556 |

*Primary Examiner*—John Sipos

*Attorney, Agent, or Firm*—Antonelli, Terry & Wands

[57] ABSTRACT

A stretch wrapping machine is disclosed having a pre-stretcher having a single driven roller and a controlled supply roll of stretchable wrapping material. In several embodiments, a variable ratio transmission varies the ratio of the rotational velocity of the driven roller and the rotational velocity of the supply roll to maintain a substantially constant ratio of the peripheral velocity of the driven roller to the peripheral velocity of the supply roll. In several embodiments, a brake applies a variable braking force to the supply roll to maintain a substantially constant ratio of the peripheral velocity of the driven roller to the peripheral velocity of the driven roller.

27 Claims, 12 Drawing Sheets

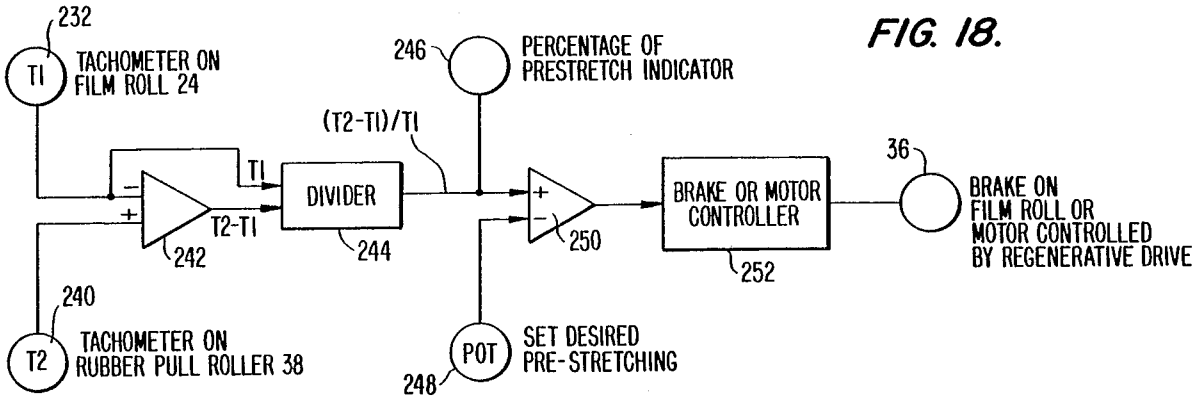
FIG. 18.
BRAKE ON FILM ROLL OR MOTOR CONTROLLED BY REGENERATIVE DRIVE
36
BRAKE OR MOTOR CONTROLLER
252
PERCENTAGE OF PRESTRETCH INDICATOR
250
SET DESIRED PRE-STRETCHING
POT
248
246
(T2-T1)/T1
DIVIDER
244
T1
T2-T1
242
TACHOMETER ON FILM ROLL 24
232
T1
TACHOMETER ON RUBBER PULL ROLLER 38
240
T2

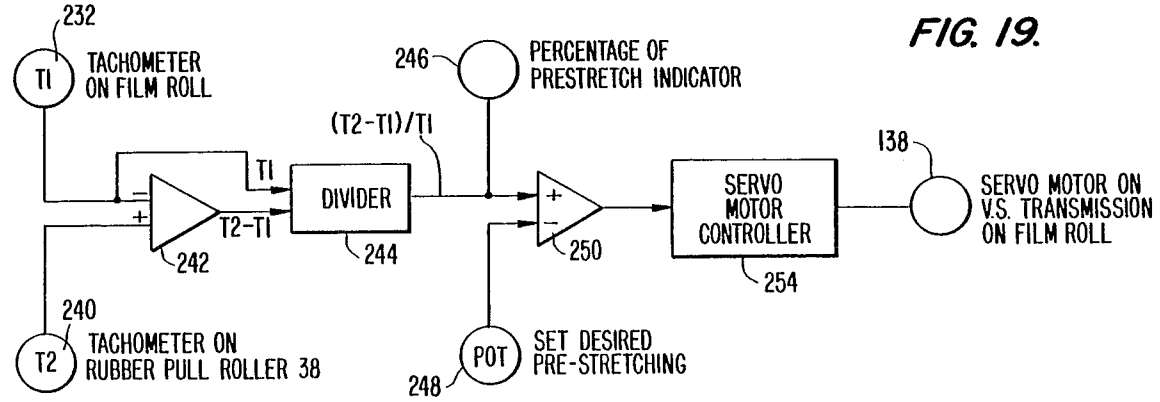
FIG. 19.
SERVO MOTOR ON V.S. TRANSMISSION ON FILM ROLL
138
SERVO MOTOR CONTROLLER
254
PERCENTAGE OF PRESTRETCH INDICATOR
250
SET DESIRED PRE-STRETCHING
POT
248
246
(T2-T1)/T1
DIVIDER
244
T1
T2-T1
242
TACHOMETER ON FILM ROLL
232
T1
TACHOMETER ON RUBBER PULL ROLLER 38
240
T2

STRETCH WRAPPING MACHINE

CROSS-REFERENCE TO RELATED APPLICATIONS

This is a divisional application of U.S. Ser. No. 813,074, filed Dec. 24,1985, now U.S. Pat. No. 4,693,049; which is a continuation-in-part of U.S. Ser. No. 374,741, filed May 4, 1982, now U.S. Pat. No. 4,590,746; and which is a continuation-in-part of U.S. Ser. No. 307,283, filed Sept. 30, 1981, now abandoned. Each of the above-referenced applications is incorporated herein by reference in their entirety.

BACKGROUND OF THE INVENTION

1. Field of the Invention

The present invention relates to stretch wrapping machines having prestretchers for elongating a stretchable wrapping material from its initial length as unwound from a supply roll to a controlled elongation prior to wrapping of a load located on a rotatable turntable. More particularly, the invention relates to prestretchers which utilize a single power driven roller to achieve prestretching.

2. Description of the Prior Art

French Pat. No. 2,281,275 to Thimon discloses a prestretching system which utilizes a pair of power driven rollers to achieve prestretching of a stretchable wrapping material prior to the wrapping of a load located on a rotatable load support. In this patent it is taught that the speed of the downstream roller is greater than the upstream roller located closest to the supply roll to achieve stretching of the stretchable wrapping material. The relative velocities of the rollers controls the amount of prestretching.

U.S. Pat. No. 4,418,510 discloses a process similar to that disclosed in Thimon. A pair of driven rollers function as a prestretcher for elongating the stretch wrapping material prior to wrapping around a load disposed on a rotatable load support. The degree of elongation is controlled by the relative peripheral velocities of the pair of rollers. U.S. Pat. No. 4,418,510 also discloses that the combination of a single power driven roller and a braked film supply roll may be used to perform prestretching.

Stretching of stretchable wrapping material between the load to be wrapped and the supply roll has also been accomplished by the use of a friction brake for varying the degree of force required to unwind the stretch wrapping material during wrapping of the load which controls the degree of stretch achieved from the nominal dimension of the stretchable wrapping material as wound on the supply roll. However, conventional friction brakes are difficult to control when objects with corners are being wrapped because of the cyclical variation of the wrapping speed of the stretchable wrapping material around the object as a consequence of corner passage.

SUMMARY OF THE INVENTION

The present invention is a stretch wrapping machine having a prestretching unit utilizing a single power driven roller for prestretching stretchable wrapping material contained on a supply roll of stretchable wrapping material. Prestretching is achieved by controlling the braking force applied by a brake to a roll of stretchable wrapping material or by driving a single driven roller and the supply roll with a variable ratio transmission controlled by a servo mechanism.

The brake is controlled by a mechanism for applying substantially constant tension to the stretchable wrapping material between the supply roll and the driven roller by the application of a constant force biased against the stretchable wrapping material and a tension sensor which senses changes in the tension between the supply roll and the driven roller to generate a control signal for controlling the brake, by a control signal generated by a diameter sensor which senses the change in the outside diameter of the supply roll occurring during stretch wrapping which is caused by the unrolling of the stretchable wrapping material or by a control signal generated by a ratio comparison of the peripheral velocity of the driven roller to the peripheral velocity of the supply roll. The variable ratio transmission is controlled by a mechanism for applying substantially constant tension to the stretchable wrapping material between the supply roll and the driven roller by the application of a constant force biased against the stretchable wrapping material and a tension sensor which senses changes in the tension between the supply roll and the driven roller to generate a control signal for controlling the brake, by a control signal generated by a diameter sensor which senses the change in the outside diameter of the supply roll of stretchable wrapping material occurring during stretch wrapping which is caused by the unrolling of the stretchable wrapping material or by a control signal generated by a ratio comparison of the peripheral velocity of the driven roller to the peripheral velocity of the supply roll of stretchable wrapping material.

Preferably, the single power driven roller is driven by a DC motor controlled by a DC regenerative controller which isolates the prestretching mechanism from variations in the velocity of the stretchable wrapping material caused by the wrapping of objects with corners.

The addition of an accumulating mechanism for stretchable wrapping material located between the single power driven roller and the rotatable turntable, which provides additional stretchable wrapping material during the increase in velocity of stretchable wrapping material and which takes up stretchable wrapping material during the decrease in the velocity of the stretchable wrapping material that occurs during the wrapping of loads with corners, isolates the prestretcher from the effects of the variation in velocity during stretch wrapping without requiring variation in the speed of the motor driving the driven roller. Preferably the accumulator is located in a mechanism for applying a constant wrapping tension during the wrapping of the load. The constant tension wrapping mechanism enables the precise control of the degree of additional stretching or relaxation of the stretchable wrapping material which occurs after the prestretched wrapping material leaves contact from the power driven roller.

The prestretcher in combination with the constant tension maintaining mechanism located between the single power driven roller and the rotatable load support provides a degree of control of prestretching and stretching or relaxation between the prestretcher and the load which is heretofore only been achievable by stretch wrapping machines marketed by International Packaging Machines as Models 8200 UTS and LP 8200 UTS which utilized a pair of power driven rollers to perform prestretching.

A wrapping machine for wrapping a load placed on a rotatable turntable with a stretchable wrapping material including a prestretcher for stretching the stretchable wrapping material prior to wrapping around the load in accordance with first, second, third and fourth embodiments of the invention includes a rotatable holder for holding a roll of stretchable wrapping material which supplies the stretchable wrapping material to be wrapped around the load; a driven roller disposed between the roll of stretchable wrapping material and the turntable which contacts the stretchable wrapping material for applying a force to the stretchable wrapping material to cause prestretching, a driven roller disposed between the roll of stretchable wrapping material and the rotatable turntable which contacts the stretchable wrapping material for applying a force to the stretchable wrapping material to cause prestretching; a variable speed electric motor coupled to the driven roller to cause prestretching of the stretchable wrapping material disposed between the roll of stretchable wrapping material and the driven roller; and a mechanism for applying substantially constant tension to the stretchable wrapping material disposed between the rotatable holder and the driven roller including a constant force applying mechanism biased against the stretchable wrapping material for applying a constant force to the stretchable wrapping material. The first and third embodiments further include a brake coupled to the rotatable holder for applying a braking force to the rotatable holder in accordance with a control signal applied thereto to cause the stretchable wrapping material disposed on the supply roll to be restrained.

The second and fourth embodiments further include a variable ratio transmission driven by the variable speed electric motor for driving the rotatable holder and the driven roller for maintaining a rotational speed ratio of the driven roller to the rotatable holder with the rotational speed ratio decreasing under the control of a control signal as the stretchable wrapping material is unwound from the roll of stretchable wrapping material to maintain a substantially constant ratio of the peripheral velocity of the driven roller to the peripheral velocity of the roll of stretchable wrapping material.

In the first, second, third and fourth embodiments, the constant force applying mechanism applies a constant force to a movable element which contacts the stretchable wrapping material disposed between the rotatable holder and the driven roller which moves in a first direction when tension of the stretchable wrapping material contacting the movable element increases and which moves in a second direction when the tension of the stretchable wrapping material contacting the movable element decreases, and a control signal generator senses the movement of the movable element and generates the control signal which increases as a function of movement in the first direction and which decreases as a function of movement in the second direction.

Furthermore, in accordance with the first embodiment of the invention, a means for maintaining substantially constant tension may be disposed between the driven roller and the rotatable turntable which controls the speed of the variable speed electric motor as a function of velocity sensed on the stretchable wrapping material located between the driven roller and the turntable. The means for maintaining substantially constant tension may comprise a first arm pivotably mounted for rotation around a fixed point through a path of rotation; a tension roller rotatably mounted on the first arm at a point offset from the fixed point, the tension roller engaging the stretchable wrapping material to define a path of approach of the stretchable wrapping material between the dispensing means and the tension roller, and a path of departure of the stretchable wrapping material between the tension roller and the rotatable turntable; the first arm defining a first angle with the path of approach of the stretchable wrapping material and a second angle with the path of departure of the stretchable wrapping material, the first and second angles being substantially equal within the path of rotation and varying with rotation of the arm through the path of rotation; a second arm pivoted about the fixed point which is connected to the first arm or is part of the first arm; and a constant force applying mechanism for applying a constant force to the second arm at a point offset from the pivot point which opposes a force applied to the first arm by tension on the stretchable wrapping material in the paths of approach and departure, the second arm and the means for applying a constant force defining a third angle which is substantially equal to the first and second angles within the path of rotation of the first arm. The path of departure may be defined by a suitably placed roller or by the position of the rotatable turntable with respect to the tension roller to produce the required angular relationships.

With the first embodiment of the invention, the mechanism for maintaining substantially constant tension further includes a sensor for sensing when the first arm moves past a first angular limit at a boundary of a first control zone into a second control zone within the path of rotation that is caused by an increase in the velocity of the stretchable wrapping material being wrapped around the load and for sensing when the first arm moves past a second angular limit at a boundary of the first control zone into a third control zone within the path of rotation that is caused by a decrease in the velocity of the stretchable wrapping material being wrapped around the load; and a controller coupled to the motor for rotating the driven roller to increase the speed of the motor for causing the stretchable wrapping material leaving contact with driven roller to increase in velocity in response to the means for sensing when the first arm moves past the first angular limit into the second control zone, to decrease the speed of the motor for causing stretchable wrapping material leaving contact with the driven roller to decrease in velocity in response to the means for sensing when the first arm moves past the second angular limit into the third control zone and for causing the motor to maintain a substantially constant velocity of the stretchable wrapping material leaving contact with the driven roller as long as the first arm is within the first zone.

In accordance with the second and fourth embodiments of the invention, the variable ratio transmission includes a servo mechanism for varying the ratio of the transmission as a function of the control signal.

The second embodiment of the invention further includes a mechanism for maintaining substantially constant tension in the stretchable wrapping material being wrapped around the load which engages the stretchable wrapping material after it leaves contact with the driven roller. The mechanism for maintaining substantially constant tension is identical to the mechanism for maintaining substantially constant tension described above with reference to the first embodiment.

A wrapping machine for wrapping a load placed on a rotatable turntable with a stretchable wrapping material including a prestretcher for stretching the wrapping material prior to wrapping around the load in accordance with fifth and seventh embodiments of the invention comprises a rotatable holder for holding a roll of stretchable wrapping material which supplies the stretchables wrapping material to be wrapped around the load; a brake coupled to the rotatable holder for applying a braking force to the holder in accordance with a control signal applied thereto to cause the film disposed on the rotatable holder to be restrained; a driven roller disposed between the roll of stretchable wrapping material and the rotatable turntable which contacts the stretchable wrapping material for applying a force to the stretchable wrapping material to cause prestretching; a motor, which is controlled by a regenerative drive, for rotating the driven roller to cause prestretching of the wrapping material disposed between the roll of wrapping material and the driven roller, the regenerative drive being settable to change the speed of the motor to change the speed of the stretchable wrapping material leaving the driven roller and functioning to resist the take up of stretchable wrapping material leaving contact from the driven roller at a speed faster than the set speed that is caused by wrapping of loads; and a sensor for sensing change in the outside diameter of the supply roll of stretchable wrapping material and for generating the control signal which is a function of the change in diameter of the supply roll.

The fifth embodiment of the present invention further includes a mechanism for maintaining substantially constant tension in the stretchable wrapping material being wrapped around the load which engages the stretchable wrapping material after it leaves contact with the driven roller. The mechanism for maintaining substantially constant tension is identical to the mechanism for maintaining substantially constant tension of the first and second embodiments.

A wrapping machine for wrapping a load placed on a rotatable turntable with a stretchable wrapping material including a prestretcher for stretching the stretchable wrapping material prior to wrapping around the load in accordance with sixth and eight embodiments of the invention includes a rotatable holder for holding a roll of stretchable wrapping material which supplies the wrapping material to be wrapped around the load; a driven roller disposed between the roll of stretchable wrapping material and the turntable which contacts the stretchable wrapping material for applying a force to the stretchable wrapping material to cause prestretching; a motor for rotating the driven roller; a variable ratio transmission for driving the rotatable holder and the driven roller for maintaining a rotational speed ratio of the driven roller to the rotatable holder with the rotational speed ratio decreasing as the stretchable wrapping material is unwound from the roll of stretchable wrapping material under the control of a control signal to maintain a substantially constant ratio of the peripheral velocity of the driven roller to the peripheral velocity of the roll of stretchable wrapping material; and a sensor for sensing the outside diameter of the roll of supply material and for generating the control signal which is applied to the variable ratio transmission.

Further in accordance with the sixth embodiment of the invention, the sensor for sensing the outside diameter comprises a sensing element biased against the periphery of the roll of stretchable wrapping material for sensing the decrease in the diameter of the roll of stretchable wrapping material during the wrapping of loads; a potentiometer coupled to the sensing element for varying the resistance of the potentiometer as a function of the movement of the sensing element to produce the control signal; and wherein the variable ratio transmission includes a servo mechanism for varying the ratio of the transmission as a function of the control signal.

The sixth embodiment of the invention further comprises a mechanism for maintaining substantially constant tension in the stretchable wrapping material being wrapped around the load which engages the stretchable wrapping material after it leaves contact with the driven roller. The mechanism for maintaining substantially constant tension is identical to that of the first, second and fifth embodiments.

A wrapping machine for wrapping a load placed on a rotatable turntable with a stretchable wrapping material including a prestretcher for stretching the wrapping material prior to wrapping around the load in accordance with the ninth embodiment of the invention comprises a rotatable holder for holding a roll of stretchable wrapping material which supplies the stretchable wrapping material to be wrapped around the load; a brake coupled to the rotatable holder for applying a braking force to the holder in accordance with a control signal applied thereto to cause the film disposed on the roller to be restrained to maintain a substantially constant ratio of the peripheral velocity of the driven roller to the peripheral velocity of the roll of stretchable wrapping material; a driven roller disposed between the roll of stretchable wrapping material and the rotatable turntable which contacts the stretchable wrapping material for applying a force to the stretchable wrapping material to cause prestretching; a variable speed electric motor for rotating the driven roller to cause prestretching of the wrapping material disposed between the roll of wrapping material and the driven roller; a first velocity sensor for sensing the peripheral velocity of the roll of stretchable wrapping material and for generating a first signal representative of the sensed peripheral velocity of the roll of stretchable wrapping material; a second velocity sensor for sensing the peripheral velocity of the driven roller and generating a second signal representative of the sensed peripheral velocity of the driven roller; and a controller responsive to the first and second signals for generating the control signal. The ninth embodiment of the present invention further includes a mechanism for maintaining substantially constant tension in the stretchable wrapping material being wrapped around the load which engages the stretchable wrapping material after it leaves contact with the driven roller. The mechanism for maintaining substantially constant tension is identical to the mechanism for maintaining substantially constant tension of the first, second, fifth and sixth embodiments. The mechanism for maintaining substantially constant tension may be omitted.

A wrapping machine for wrapping a load placed on a rotatable turntable with a stretchable wrapping material including a prestretcher for stretching the stretchable wrapping material prior to wrapping around the load in accordance with a tenth embodiment of the invention includes a rotatable holder for holding a roll of stretchable wrapping material which supplies the wrapping material to be wrapped around the load; a driven roller disposed between the roll of stretchable wrapping material and the rotatable turntable which contacts the stretchable wrapping material for applying a force to the stretchable wrapping material to cause prestretching; a variable speed electric motor for rotating the driven roller; a variable ratio transmission for driving the rotatable holder and the driven roller for maintaining a rotational speed ratio of the driven roller to the rotatable holder with the rotational speed ratio decreasing as the stretchable wrapping material is unwound from the roll of stretchable wrapping material under the control of a control signal to maintain a substantially constant ratio of the peripheral velocity of the driven roller to the peripheral velocity of the rotatable holder, a first velocity sensor for sensing the peripheral velocity of the roll of stretchable wrapping material and for generating a first signal representative of the sensed peripheral velocity of the roll of stretchable wrapping material, a second velocity sensor for sensing the peripheral velocity of the driven roller and generating a second signal representative of the sensed peripheral velocity of the driven roller; and a controller responsive to the first and second signals for generating the control signal. The tenth embodiment of the present invention further includes a mechanism for maintaining substantially constant tension in the stretchable wrapping material being wrapped around the load which engages the stretchable wrapping material after it leaves contact with the driven roller. The mechanism for maintaining substantially constant tension is identical to the mechanism for maintaining substantially constant tension of the first, second, fifth, sixth and ninth embodiments. The mechanism for maintaining substantially constant tension may be omitted.

BRIEF DESCRIPTION OF THE DRAWINGS

FIG. 18 is a control circuit for the ninth embodiment of the present invention.

FIG. 19 is a control circuit for the tenth embodiment of the present invention.

DESCRIPTION OF THE PREFERRED EMBODIMENTS

Figure 1:
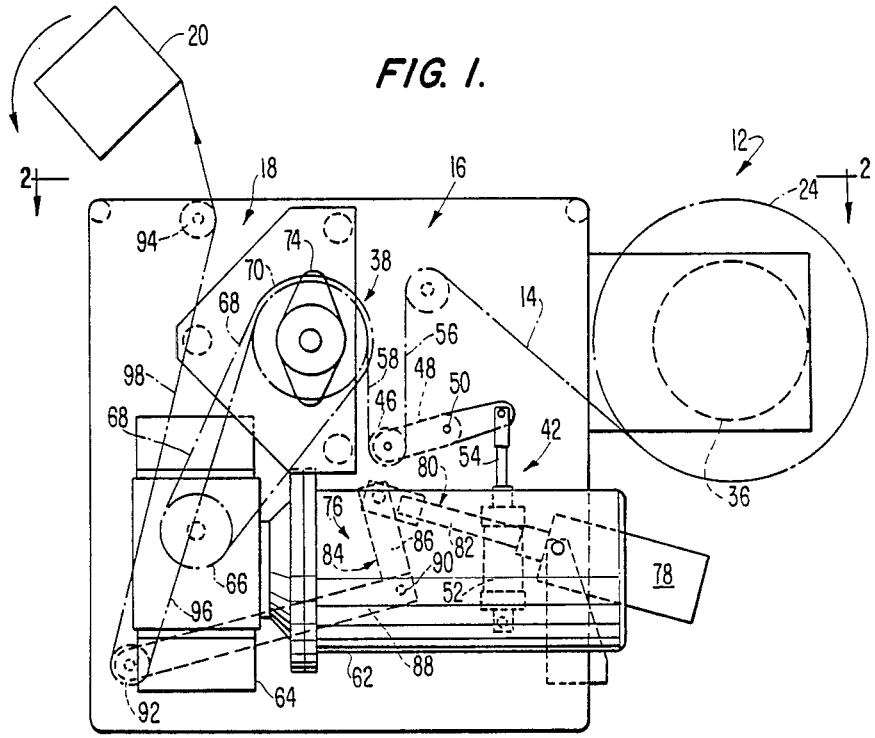
FIG. 1 is a top plan view of a first embodiment of the present invention.
Figure 2:
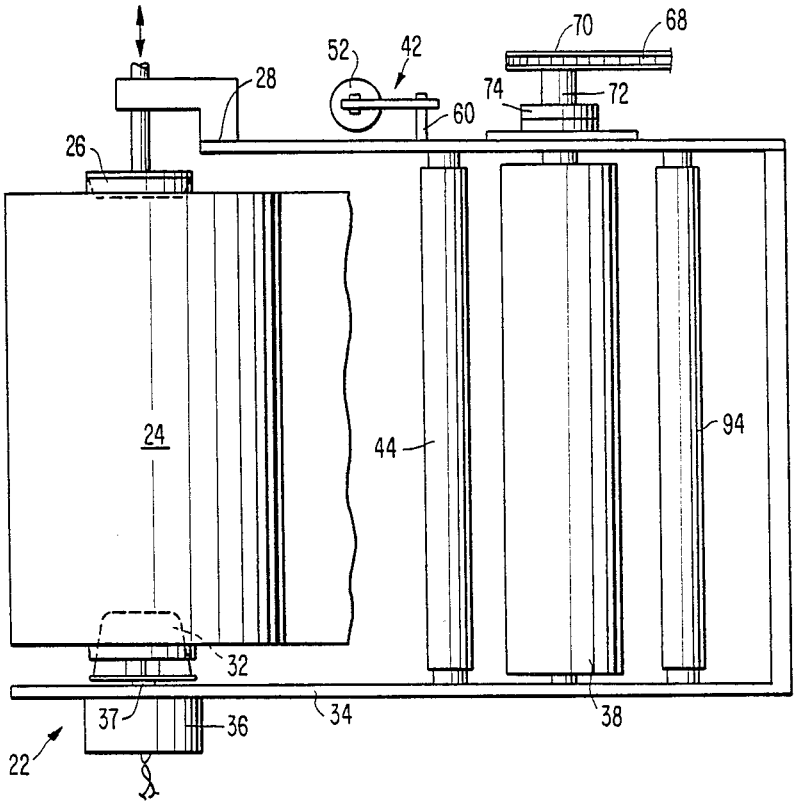
FIG. 2 is an elevational view of FIG. 1.

FIGS. 1 and 2 illustrate a first embodiment 10 of a stretch wrapping machine in accordance with the present invention. The main elements of the first embodiment 10 are a supply of stretchable wrapping material 12 which supplies stretchable wrapping material 14 which is fed to a prestretching unit 16 where it is elongated by a drawing action. The prestretching unit 16 may elastically or inelastically stretch the stretchable wrapping material 14. The stretchable wrapping material is fed from the prestretching unit 16, where it is elongated by a set amount, to a mechanism 18 for producing substantially constant wrapping tension which wraps the prestretched stretchable wrapping material to a load positioned on a rotatable turntable 20 under substantially constant tension.

A rotatable turntable 20 may be any mechanism for producing relative rotary motion between a load and the stretchable wrapping material. These mechanisms include a turntable rotated by motor and a mechanism which has a stationary load support and a supply of stretchable wrapping material which rotates around the load support to accomplish wrapping.

The supply 12 has a chuck 22 for holding a roll 24 of stretchable wrapping material to be used in stretch wrapping loads. The chuck 22 has an upper mandrel 26 which is rotatably mounted in a horizontally disposed support plate 28 by a bushing. A lower mandrel 32 is rotatably mounted within a horizontally extending arm 34 by a bearing located within electrically powered brake 36. The upper mandrel 26 is axially displaceable upward and downward directions to permit the supply roll of stretchable wrapping material 24 to be lowered down into contact with the lower mandrel 32. Thereafter, the upper mandrel 26 is lowered to engage the supply roll of stretchable wrapping material 24. The electrically powered brake 36 is coupled to the shaft which is coupled to the lower mandrel 32 to apply a controlled braking action. A control signal, which is generated in a manner described infra, controls the magnitude of the braking action applied by brake 36. The preferred type of brake 36 is a magnetic particle brake which is a model EPB-120-8-90-14 manufactured by Electroid Company, Fade Road, Springfield N.J. 07081. The aforementioned model of brake 36 has the characteristic of producing a substantially constant braking force from a complete stop up through high speeds of rotation. The control circuit for the brake 36 is described, infra, in conjunction with FIG. 13. Alternatively, the brake 36 may be implemented by a DC motor which is controlled by a regenerative controller. DC motors controlled by regenerative controllers are commercially available. A DC motor which is controlled by a regenerative controller can function as a brake for speeds of rotation caused by a load rotating above the rotational speed at which the motor is set to run by the regenerative controller. As used herein, the terminology "brake" also covers a motor controlled by a regenerative controller.

The prestretching unit 16 has a single driven roller 38 rotatably mounted in horizontal support plate 28 be bearing 74 and in horizontal support plate 34 by a bushing. The driven roller 38 is driven by a motor which is controlled by the motor control circuit, described, infra, in conjunction with FIG. 15, to draw stretchable wrapping material 14 off of the supply roll 24 with substantially constant tension. A dancer 42 applies substantially constant tension to the stretchable wrapping material and senses changes in tension in the stretch wrapping material located between idler roller 44 and the power driven roller 38. The tension of the stretchable wrapping material located between supply roll 24 and driven roller 38 increases linearly with the decrease in the outside diameter of the stretchable wrapping material 14 when the braking force applied by brake 36 is constant. A constant tension applied to the stretchable wrapping material 14 located between supply roll 24 and driver roller 38 produces constant prestretching. During prestretching the tension is maintained substantially constant by decreasing the braking force of brake 36 linearly with the decrease in outside diameter of the supply roll of stretchable wrapping material 24.

The dancer 42 includes a constant force producing mechanism 52 which has an extensible arm rotatably connected to one end of arm 48 having idler roller 46 mounted at the other end. The arm 48 is pivoted about point 50. The constant force producing mechanism 52 is preferably an air cylinder having a self-relieving type of air regulator. Adjustment of the regulated air pressure adjusts the amount of prestretching by varying the tension applied to the stretchable wrapping material by the constant force producing mechanism 52. Small changes in the tension of the stretchable wrapping material which is contacting the idler roller 46 cause an upward or downward displacement of the idler roller which produces a corresponding opposite displacement of the extensible rod 54. Movement of the idler roller 46 in response to small changes in tension occurs until a force equilibrium is again achieved as a consequence of the variation of the braking force applied by brake 36 in a manner described, infra, in conjunction with FIG. 13.

Substantially constant tension is applied to the stretchable wrapping material by the dancer 42 as a consequence of the geometry of arm 48 and the constant force producing element 52 and the sections of stretchable wrapping material 56 and 58 being substantially parallel. The torque applied to arm 48 by the extensible arm 54 is substantially equal to and opposite to the torque applied by the tension of sections 56 and 58 as long as the angle between arm 48 and extensible arm 54 is substantially equal to the angles between the sections 56 and 58 and arm 48. The force applied to arm 48 is substantially constant for the full range of extension of extensible arm 54. The section of stretchable wrapping material 56 approaching idler roller 46 is substantially parallel to the section of stretchable wrapping material 58 leaving the idler roller. A shaft 60 (FIG. 2) is attached to the arm 48 which rotates about the pivot point 50. The shaft 60 is attached to a potentiometer or equivalent (illustrated in FIG. 13 as 134) for producing a control signal for brake 36 which is a function of the rotary position of arm 48. The output signal produced by the potentiometer 134 or equivalent varies linearly with changes in tension in sections 56 and 58 as a consequence of the unrolling of the roll of stretchable wrapping material 24 and is used as the control signal for the brake 36.

An increase in the tension of the stretchable wrapping material in sections 56 and 58 produced by a decrease in the diameter of supply roll 24 causes the idler roller 46 to move upward. The upward movement of idler roller 46 rotates shaft 60 which varies the control signal produced by potentiometer 134 to decrease the braking force applied by the brake 36 to the roll of stretchable wrapping material 24 to bring the tension back to the level at which it was initially set by the constant force producing element 52.

The driven roller 38 of the constant tension maintaining mechanism 18 is rotated by a variable speed electric motor 62 through a power train comprised of transmission 64 which drives sprocket 66, chain 68 and sprocket 70. The present invention achieves both prestretching and constant tension wrapping by powered drive of driven roller 38 from the single motor 62. The driven roller 38 is connected to a shaft 72 which is connected to sprocket 70 and rotatably supported by bearing 74 mounted in horizontal support plate 28. A dancer 76 in combination with a motor controller, which is described, infra, in conjunction with FIG. 15, functions to maintain substantially constant tension on the stretchable wrapping material that is wrapped around a load located on the turntable 20.

Figure 16:
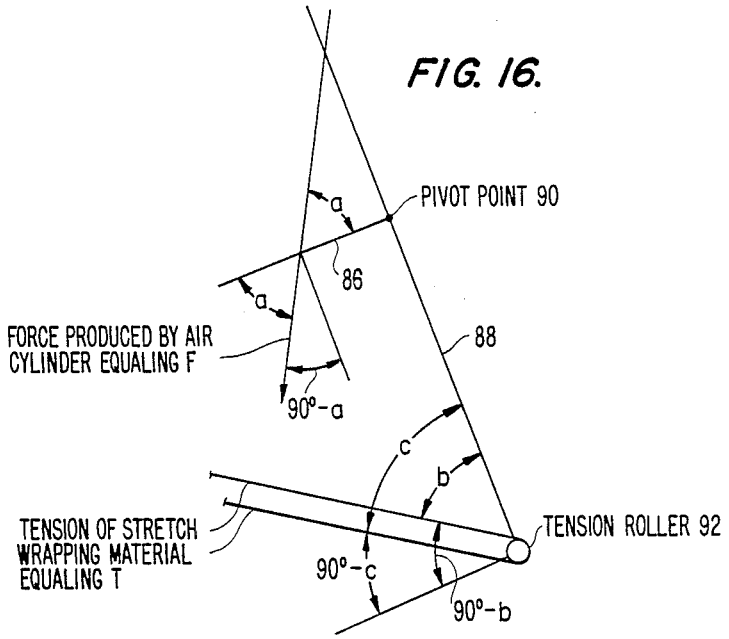
FIG. 16 is a digram of vector forces during operation of the mechanism for maintaining substantially constant tension mechanism which is located downstream from the prestretcher.
Figure 17:
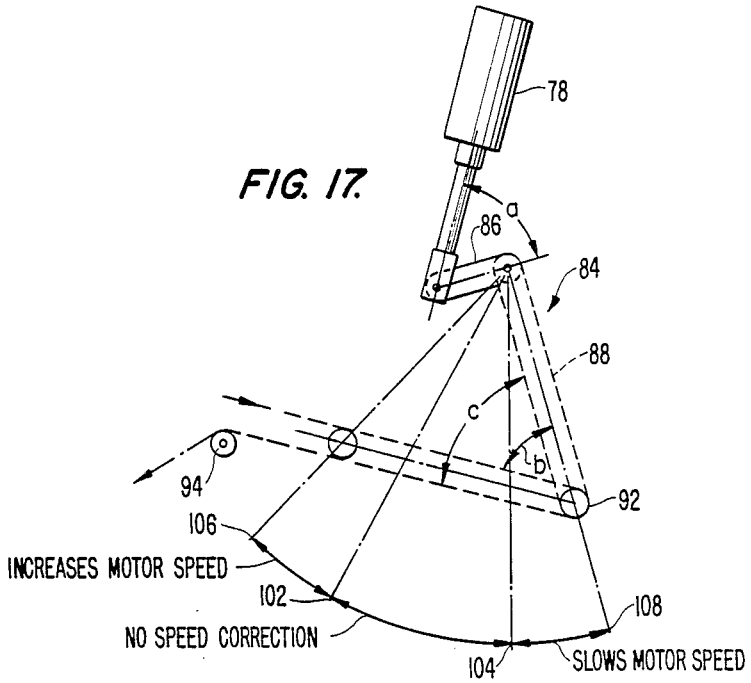
FIG. 17 is an illustration of the operation of the motor controller of FIG. 15 as a function of the angular position of the dancer.

The dancer 76 has a geometry producing a torque acting through fixed pivot point 90 caused by the tension on the stretchable wrapping material which equals, opposes and varies directly with the torque acting through the pivot point 90 caused by a constant force producing mechanism 78 so that the wrapping tension does not vary with changes of position of the dancer. The constant force producing mechanism 78 has an air cylinder having a self-relieving type air regulator which produces a constant force which is applied to linkage 80. While the tension is maintained constant during a stretch wrapping operation, the tension can be varied from one operation to the next by regulating or adjusting the air pressure to the air regulator of the air cylinder itself or the air cylinder position with respect to tension roller 38. The linkage consists of extensible rod 82 and an L-shaped member 84 having connected sections 86 and 88. The L-shaped member 84 is pivotably attached to the extensible member 82. The L-shaped member 84 is pivoted about fixed point 90. Tension roller 92 is carried on the end of the section 88 opposite pivot point 90. The spacing of the idler roller 92 with respect to the power driven roller 38 and fixed idler roller 94 causes the section of stretchable wrapping material in the path of approach 96 to the tension roller 92 and the section of stretchable wrapping material in the path of departure 98 moving away from the tension roller 92 to be substantially parallel during movement of the L-shaped member 84 in response to differential changes in tension in the stretchable wrapping material being wrapped around a load located on the turntable 20 as a consequence of corner passage of multisided loads. The tension roller 92 has been omitted from FIG. 2. The angles a, b and c, as illustrated in FIGS. 16 and 17, are substantially equal. While the preferred manner of controlling the path of departure 98 so that angle c of FIGS. 16 and 17 is substantially equal to angles a and b, is with idler roller 94, it should be understood that the idler roller 94 may be eliminated by the suitable positioning of the center of the turntable 20 in line with the desired path of departure 98 and the displacement of the turntable from the tension roller 92 such that the direction of the path of departure 98 does not substantially change with corner passage.

With reference to FIGS. 16 and 17, the combination of the substantial parallel sections of stretchable wrapping material defined between the path of approach 96 and the path of departure 98, which causes angles b and c to be substantially equal, the angle a being substantially equal to angles b and c and the application of a constant force opposing the tension of the stretchable wrapping material in the path of approach 96 and the path of departure 98 produces substantially constant tension stretch wrapping. The tension on the stretchable wrapping material in the path of approach 96 and path of departure 98 acting through pivot point 90 does not substantially vary between the angular limits 106 and 108 illustrated in FIG. 17 because of the geometry involving angles a, b and c. The torque applied by the constant force producing air cylinder 78, as applied by the extensible rod 82 and first section 86 of the L-shaped member 84 through pivot point 90, is substantially equal to and opposes the torque applied by the tension on the stretchable wrapping material acting through the second section 88 of the L-shaped member 84 independent of the rotary position of the dancer 76 between the angular limits 106 and 108.

The torques acting through pivot 90 are analyzed mathematically as follows in conjunction with FIG. 16. As illustrated, the tension of the stretch wrapping material in both path of approach 96 and path of departure 98 acts against the tension roller 92 to bias the section 88 to rotate clockwise. The torque at pivot point 90, produced by the application of the constant force F by air cylinder 78 to section 86, is expressed as follows:

$$\text{Torque} = F \cos(90° - a)\ (\text{length of section } \mathbf{86}) \quad (1).$$

The torque acting at pivot point 90 as applied by the tension of the stretch wrapping material having a tension of T is expressed as follows:

$$\text{Torque} = T \cos(90° - b)\ (\text{length of section } \mathbf{88}) + T \cos(90° - c)\ (\text{length of section } \mathbf{88}). \quad (2)$$

Under conditions of substantial equilibrium, equation no. (b 1) equals equation no. (2).

$$T \cos(90° - b)\ (\text{length of section } 88) + T \cos(90° - c)\ (\text{length of section } 88) = F \cos(90° - a)\ (\text{length of section } 86). \quad (3)$$

When angles a, b and c are substantially equal, equation (3) simplifies to $$2T\ (\text{length of section } 86) = F\ (\text{length of section } 88) \quad (4)$$

$$T = \frac{F}{2}\ \frac{(\text{length of section } 88)}{(\text{length of section } 86)} \quad (5)$$

Thus, the tension T is substantially constant between points 106 and 108, where angles a, b and c are substantially equal. Moreover, since the torques vary as a function of trigonometric relationships as set forth, supra, variations of the actual geometric relationships of many degrees from the desired geometrical relationships in which angles a, b and c are being equal do not substantially affect the maintenance of substantially constant tension.

With reference to FIG. 17, it has been found that the control of the speed of the driven roller 38 in response to movement of the dancer 76 past angular limit 102 with motor 62 driven with a regenerative drive 122 (FIG. 15) to increase the speed of the roller 38 in response to an increase in velocity of the stretch wrapping material at the turntable 20 helps prevent breakage of the stretchable wrapping material. Additionally, the maintenance of substantially constant wrapping tension permits the stretchable wrapping material to be further elongated past the elongation produced by the prestretching unit 16 described, supra, to achieve an additional constant degree of elongation. Since wrapping of loads with corners does not substantially change the wrapping tension, the additional degree of elongation achieved by the load taking up the prestretch wrapping material under constant tension permits the prestretched stretchable wrapping material to be controllably elongated up to close to the breakage point which is not possible with prior art systems. Any increase in the demand for stretchable wrapping material which tends to cause overspeeding of the power driven roller 38 above its rated velocity, will be opposed by the inherent braking action of motor 62 driven by the regenerative drive 122. The speed control produced by the regenerative drive 122 is beneficial in isolating speed changes caused by the shape of the package from being translated to the prestretching unit 16.

Figure 15:
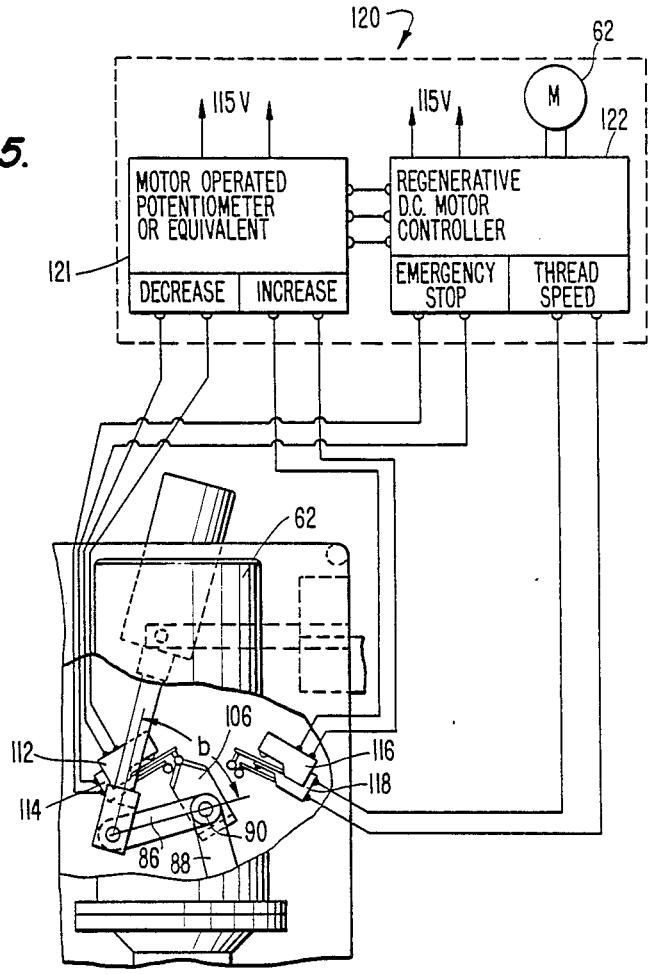
FIG. 15 is a control circuit for the motor driving the substantially constant tension maintaining mechanism of the first, second, fifth, sixth, ninth and tenth embodiments of the present invention.

FIG. 15 illustrates a motor controller 120 of the motor 62. Cam 106, which is mounted on the end of section 88 of the L-shaped member 84 at pivot point 90, controls the closure microswitches 112–118. The microswitch 112 is closed when the section 88 rotates counterclockwise past angular limit 104 (FIG. 17) to slow down the rotation of the driven roller 38 to reduce the rate of supply of stretchable wrapping material being fed to the constant tension maintaining mechanism 18 which causes the section 88 to rotate clockwise past angular limit 104 within the zone where no motor speed control is produced by the motor controller 120. The microswitch 114 is closed when the stretchable wrapping material breaks which causes the activation of an emergency stop dynamic braking circuit. When activated, the emergency stop dynamic braking circuit instantaneously stops the motor 62 which drives the driven roller 38. The microswitch 116 is closed when the section 88 rotates clockwise past angular limit 102 to speed up the rotation of the driven roller 38 to increase the rate of supply of stretchable wrapping being fed to the constant tension maintaining mechanism 18 which causes the section 88 to rotate counterclockwise past angular limit 102 within the zone where no speed control is produced by motor controller 120. The microswitch 118 is closed manually when the dancer 76 is pushed against the resistance of a spring (not illustrated) to run the driven roller 38 at a slow speed used only during threading of the stretchable wrapping material. The regenerative controller 122 may be provided with a speed controller (not illustrated) which permits manual control of the speed of the driven roller 38 to match the demand for the stretchable wrapping material by the load being wrapped on the turntable 20 with the prestretched stretchable wrapping material being provided by the prestretcher 16.

It should be understood that the microswitches 112 and 116 may be replaced with any known position sensing mechanism. For example, models 8200 UTS and LP 8200 UTS of the assignee's stretch wrapping machines sold under the trademark UNITENSION® use an optical sensor in place of the above-referenced microswitches.

The motor controller 120 may be any known system for controlling the motor 62 for driving the power driven roller 38. As illustrated in FIG. 15, the motor controller 120 includes a motor operated potentiometer (MOP) 121 which may be a model SS MOP-1 manufactured by Precision D Series, Inc., 63 Nicholas Road, Framingham, Mass., and a regenerative DC motor controller 122 which may be a model RG 8 manufactured by Southcon Corporation, 3608 Rozzels ferry Road, Charlotte, N.C. The output of the regenerative DC motor controller 122 is applied to motor 62 which drives the driven roller 38 as described, supra, in conjunction with FIG. 1. The function of the regenerative DC motor controller 122 is to maintain the output shaft speed of the motor 62 constant independent of torque. As is known, a DC motor controlled by a regenerative controller functions as a brake to the motor load when the motor is being driven by the load at a speed higher than the rated speed of the controller. The function of the motor operated potentiometer 121 or equivalent, is upon the closure of microswitch 112 and microswitch 116 to vary the resistance of the potentiometer to produce a control signal respectively to increase and to decrease the velocity of the motor driving the power driven roller 38. The output signal which is applied from the motor operated potentiometer 121 to the regenerative DC motor controller 122 is maintained at a constant potential as long as the idler roller stays within the section labelled "no need correction" as illustrated in FIG. 17.

Other known motor controllers 120 may be used in place of the specific embodiment described, supra, in FIG. 15. For example, in the above-referenced models 8200 UTS and LP 8200 UTS of stretch wrapping machines, an optical position sensing system performs the functions of the microswitches 112 and 116 and motor operated potentiometer 121. In that system, switches 114 and 118 are present and the generation of the variable control signal is done by an optical sensor which is not subject to mechanical wear. Moreover, other types of long life potentiometers or equivalents may be used in place of the motor operated potentiometer 121. Any known regenerative DC motor controller may be used.

The combination of the prestretching unit 16 upstream from the constant tension maintaining mechanism 18 produces precise control of the prestretching of the stretchable wrapping material 14 independent of cyclical variations in the velocity of the stretchable wrapping material being wrapped around a load located on the turntable 20 as a consequence of wrapping of multisided loads. The accumulating function, which is inherently performed by the dancer 76 between the angular limits 102 and 104, supplies additional stretchable wrapping material or takes up stretchable wrapping material during the wrapping of loads with corners without any variation in the speed at which the motor driven roller 38 is driven.

Figure 13:
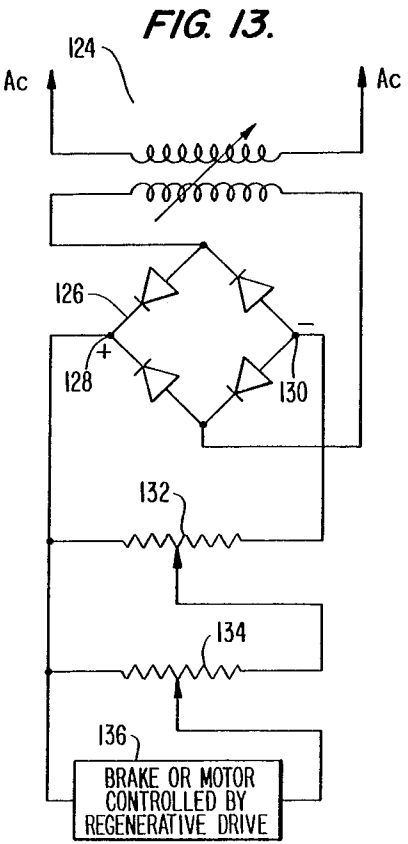
FIG. 13 is a control circuit for the brake of the first, third, fifth and seventh embodiments of the present invention.

FIG. 13 illustrates the electrical control circuit of the brake 36 of FIGS. 1 and 2. A source of alternating current 124 is applied to a full wave rectifier 126 for producing a DC output voltage on terminals 128 and 130. A master control potentiometer 132 is coupled to the terminals 128 and 130. The function of the master control potentiometer 132 is to permit adjustment of the full range of braking force which may be applied by the brake 36 to vary the amount of prestretching. Potentiometer 134 is activated by rotation of the shaft 60 to which the constant tension dancer 42 is attached. In order to obtain sufficient dynamic range of potentiometer 134, it is desirable to gear drive the potentiometer from the rotation of the constant tension dancer 42 by a ratio such as 10:1. The gear drive has been omitted from FIG. 2 since its design is conventional. Other known ways of obtaining an increased dynamic range in the generation of the control signal for the brake 36 is response to the rotation of the shaft 60 attached to the constant dancer 42 may be used. An optical sensor of the type used in the aforementioned models 8200 UTS and LP 8200 UTS of stretch wrapping machines sold under the trademark UNITENSION® may be used in place of potentiometer 134.

Figure 3:
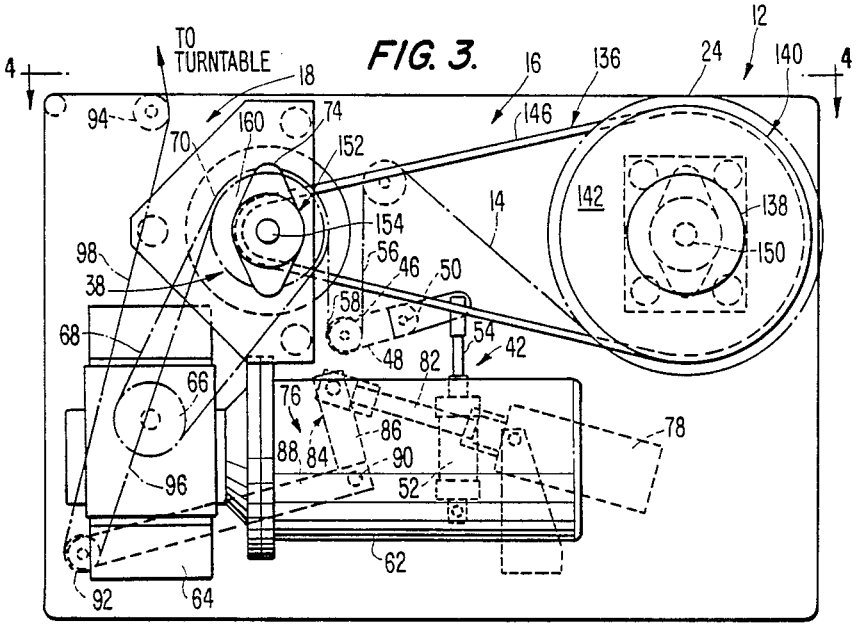
FIG. 3 is a top plan view of a second embodiment of the present invention.
Figure 4:
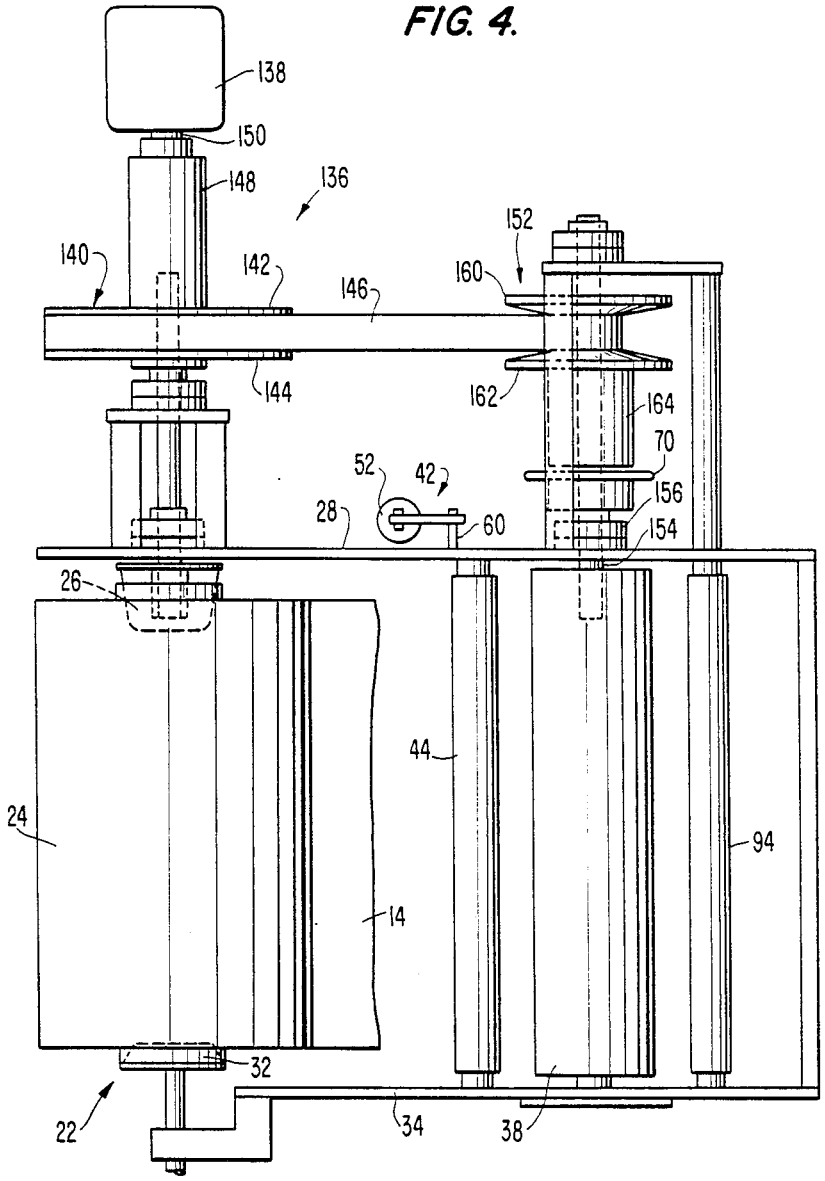
FIG. 4 is an elevational view of the second embodiment of FIG. 3.

FIGS. 3 and 4 illustrate a second embodiment of the present invention. Identical reference numerals are used to identify like parts in FIGS. 1–4. The description of the second embodiment will be limited to describing those parts which are different than the first embodiment and the difference in mode of operation. The principal difference between the first and second embodiments is that a variable ratio transmission 136 is coupled between the chuck 22 of the roll of stretchable wrapping material 24 and the power driven roller 38 to maintain a constant ratio of the peripheral velocity of the driven roller 38 to the peripheral velocity of the roll of stretchable wrapping material independent of the change of the outside diameter of the supply roll 24. The variable ratio transmission 136 decreases the rotational speed ratio of the driven roller 38 to the rotational speed of the chuck 22 as a linear function of a control signal produced by the rotation of the constant tension dancer 42. The control signal is a linear function of the tension on the stretchable wrapping material between the sections 56 and 58 as described, supra, in conjunction with FIGS. 1 and 2. The variable ratio transmission 136 may be any known transmission which produces a linear decrease in the rotational speed ratio between the driven roller 38 and the chuck 22 under the control of the control signal produced by the rotation of the arm 48. The preferred embodiment of the variable speed transmission 136 is illustrated in detail in FIG. 4. The tension roller 92 has been omitted from FIG. 4. Pulley 140, which is a conventional controlled pulley, has sides 142 and 144 which are inclined (not illustrated) to engage the slanted surfaces of a v-belt 146 and which are movable with respect to each other to vary the diameter presented to the v-belt. Because controlled pulley 140 is conventional, its detailed construction is not illustrated. The outside face of the side 142 is connected to cylindrical member 148. Rotation of shaft 150 causes face 142 to move axially with respect to face 144. The servo motor 138 is activated to rotate shaft 150 to vary the displacement of faces 142 and 144 with respect to each other. Displacement of the side 142 downward causes the v-belt to ride upward on the inside inclined surfaces of the sides 142 and 144 to effectively increase the diameter of the pulley 140. The driven roller 38 is coupled by shaft 154 to a pulley 152, which is a conventional spring pulley with sides 160 and 162 which automatically displace axially with respect to each other with a change in tension on v-belt 146. Because the spring pulley 152 is conventional, its detailed construction is not illustrated. The first side 160 of the pulley is fixed to shaft 154. The second side 12 of the pulley 152 is movable axially against the spring within the cylindrical member 164. However, it should be understood that movement of the side 162 is opposed by a spring (not illustrated) which is contained within cylinder 164. The driven roller 38 is rotatably supported in horizontal support plate 28 by bearing 156 and in horizontal support plate 34 by a bushing not illustrated. The pulley 152 changes its diameter with respect to the point of contact with the v-belt 146 in a manner which is opposite to the change in diameter of a pulley 140 caused by the servo motor 138 to maintain constant tension on the v-belt regardless of the ratio of the variable ratio transmission 136. Any change in the effective diameter of the pulley 140 caused by the servo motor 138 causes a change in the tension of the v-belt which produces movement of the second surface 162 of the pulley 152 with respect to cylindrical member 164 to a position which brings the tension back to its original value.

Figure 14:
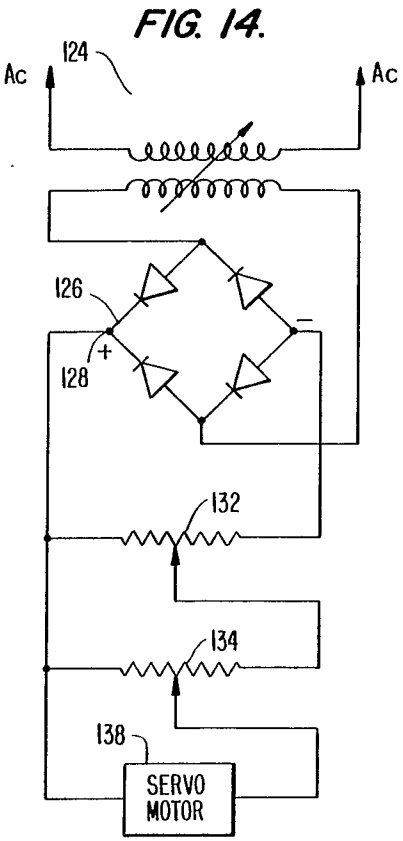
FIG. 14 is a control circuit of the servo mechanism of the variable ratio transmission of the second, fourth, sixth and eight embodiments of the present invention.

FIG. 14 illustrates the electrical control circuit for the servo motor 138. Identical reference numerals in FIGS. 13 and 14 identify like parts. The potentiometer 134 is moved in response to rotation of the shaft 60 attached to the constant tension dancer 42. An increase in tension in the stretchable wrapping material sensed by the constant tension dancer 42 causes rotation of the constant tension dancer upward as illustrated in FIG. 3. The control signal produced by potentiometer 134 activates the servo motor 138 to decrease the rotational speed ratio of the driven roller 38 to the rotational speed ratio of the chuck 22 to reestablish constant tension which maintains a substantially constant ratio of the peripheral velocity of the driven roller and the peripheral velocity of the roll of stretchable wrapping material 24.

Figure 5:
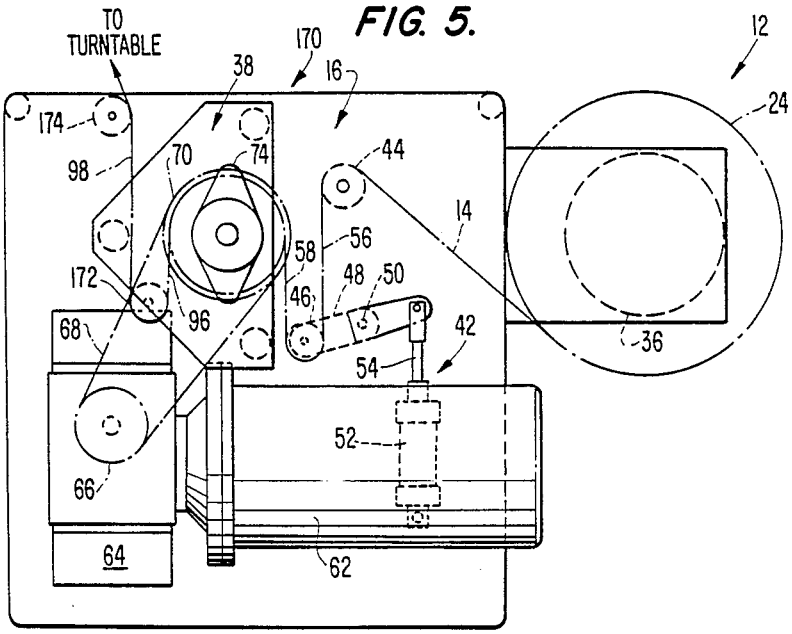
FIG. 5 is a top plan view of the third embodiment of the present invention.

FIG. 5 illustrates a third embodiment 170 of the present invention. The third embodiment of the present invention is identical to the first embodiment described, supra, in conjunction with FIGS. 1 and 2 with the exception that the mechanism for producing substantially constant tension 18 has been omitted. Identical reference numerals are used to identify like parts in FIGS. 1 and 2 and 5. A first fixed idler roller 172 and a second fixed idler roller 174 maintain the sections of stretchable wrapping material 96 and 98 substantially parallel to each other. In this embodiment, it is not necessary to maintain these sections of stretchable wrapping material 96 and 98 substantially parallel.

Figure 6:
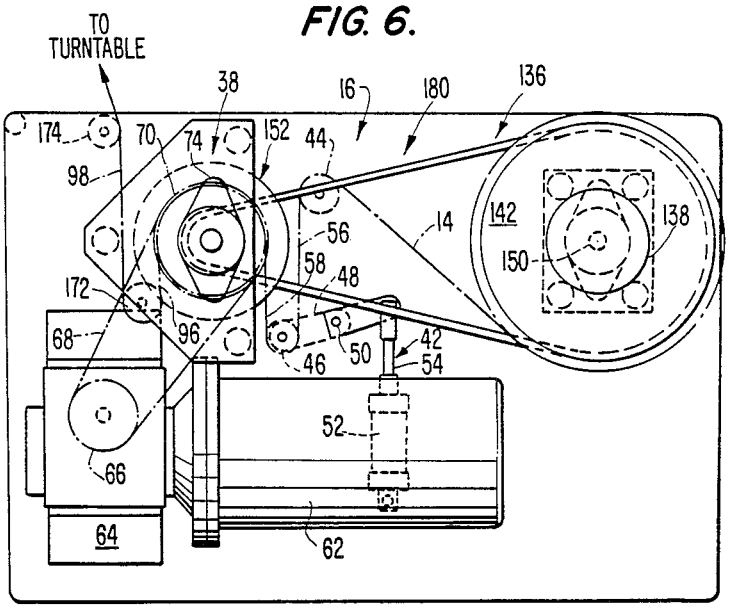
FIG. 6 is a top plan view of a fourth embodiment of the present invention.

FIG. 6 illustrates a fourth embodiment 180 of the present invention. The fourth embodiment differs from the second embodiment described, supra, in conjunction with regard to FIGS. 3 and 4 only in that the mechanism for producing substantially constant tension has been omitted. Like reference numbers identify identical parts in FIGS. 3 and 4 and 6. The first idler roller 172 and second idler roller 174 are identical to the idler rollers discussed, supra, in conjunction with FIG. 5. With the exception of the benefit of isolation provided by the constant tension maintaining mechanism 18, the operation of the prestretching unit 16 of the fourth embodiment is identical to the second embodiment.

Figure 7:
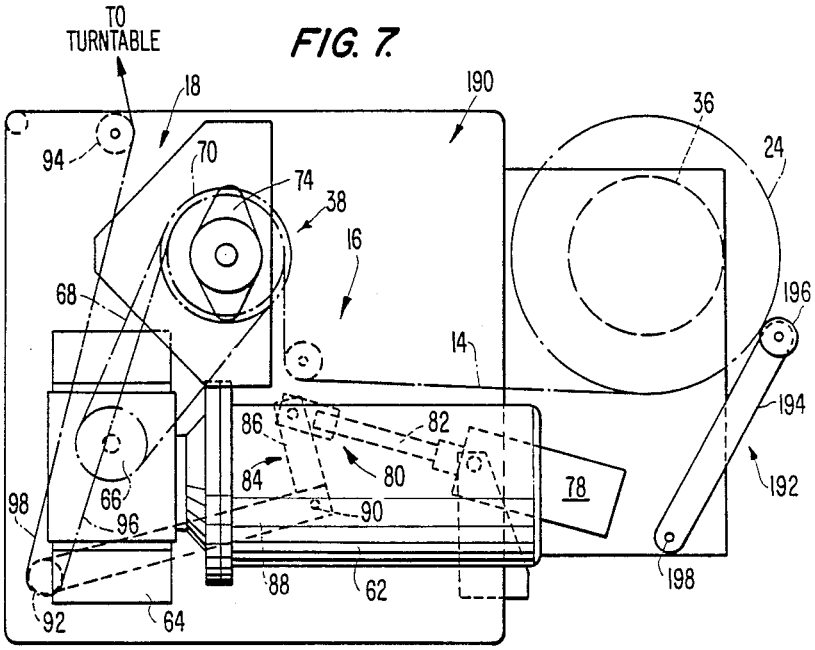
FIG. 7 is a top plan view of a fifth embodiment of the present invention.

FIG. 7 illustrates a fifth embodiment 190 of the present invention. Like reference numerals are used to identify like parts in FIGS. 1 and 2 and 7. The fifth embodiment differs from the first embodiment in that the control signal used for varying the braking force of brake 36 is generated by a diameter sensor 192. The diameter sensor 192 has a pivotably mounted arm 194 which is spring biased (not illustrated) to cause contact between an idler roller 196 on the periphery of the roll of stretch wrapping material 24. The shaft 198 is coupled to potentiometer 134 of FIG. 13. As the outside diameter of the stretch wrapping material 14 on the roll of stretchable wrapping material 24 decreases, the control signal generated by the potentiometer 134 causes a corresponding decrease in the braking force applied by brake 36 to produce a constant ratio between the peripheral velocity of the driven roller 38 and the peripheral velocity of the roll of stretchable wrapping material 24. The constant tension mechanism 18 functions to isolate changes in the velocity of stretchable wrapping material occurring during the wrapping of a load on the turntable 20 from the prestretcher 16 which produces a constant controllable prestretching.

Figure 8:
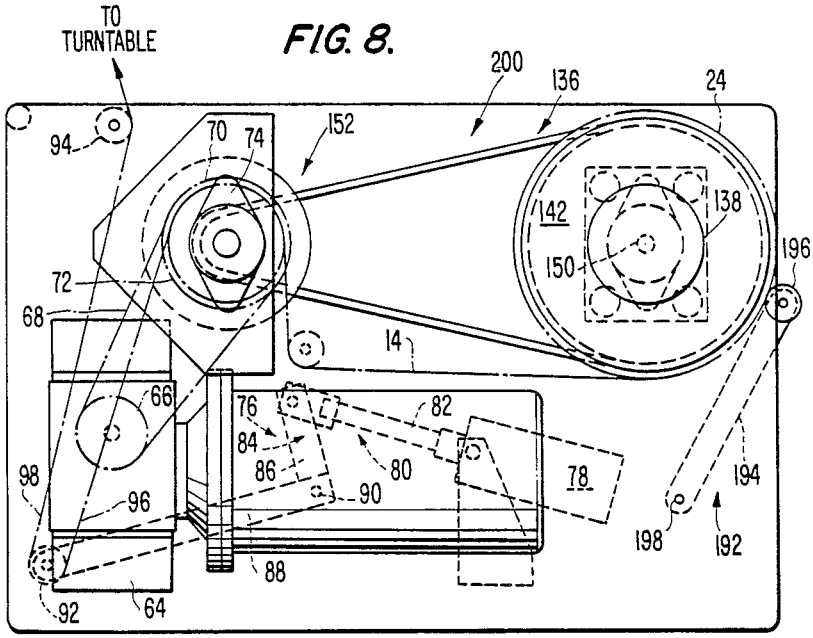
FIG. 8 is a top plan view of a sixth embodiment of the present invention

FIG. 8 illustrates a sixth embodiment 200 of the present invention. The sixth embodiment differs from the second embodiment illustrated in FIGS. 3 and 4 in that the control of the variable ratio transmission 136 is in accordance with the control signal produced by diameter sensor 192. Like reference numerals are used to identify like parts in FIGS. 3, 4 and 8. The diameter sensor is identical to the diameter sensor described, supra, in FIG. 7 regarding the fifth embodiment of the present invention. As the sensed outside diameter of the roll 24 of stretchable wrapping material 14 decreases, the control signal changes the ratio of the variable ratio transmission to decrease the ratio of the rotational velocity of the driven roller 38 to the chuck 22 to maintain a constant speed ratio between the peripheral velocity of the driven roller 38 and the peripheral velocity of the supply roll 24 of stretchable wrapping material 14 to produce constant prestretching. The constant tension mechanism 18 operates in the same manner described, supra, regarding the first, second and fifth embodiments described, supra.

Figure 9:
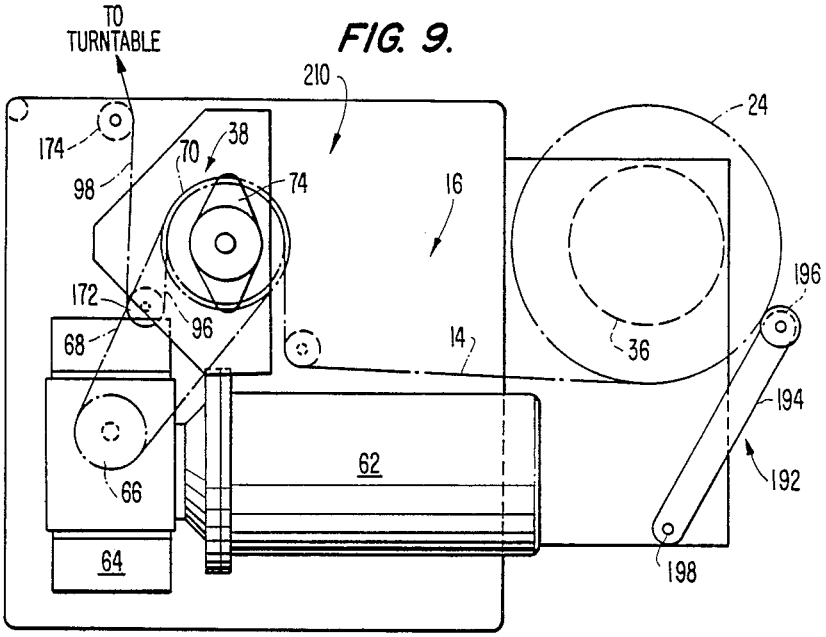
FIG. 9 is a top plan view of a seventh embodiment of the present invention.

The seventh embodiment 210 of the present invention is illustrated in FIG. 9. The difference between the seventh embodiment illustrated in FIG. 9 and the illustrated in FIG. 7 is that the constant tension maintaining mechanism 18 has been omitted and in place thereof fixed idler rollers 172 and 174 have been added. Like reference numerals identify like parts in FIGS. 7 and 9. With the exception of the benefit of isolation provided by constant tension maintaining mechanism 18, the operation of the prestretching unit 16 of the seventh embodiment is identical to the fifth embodiment.

Figure 10:
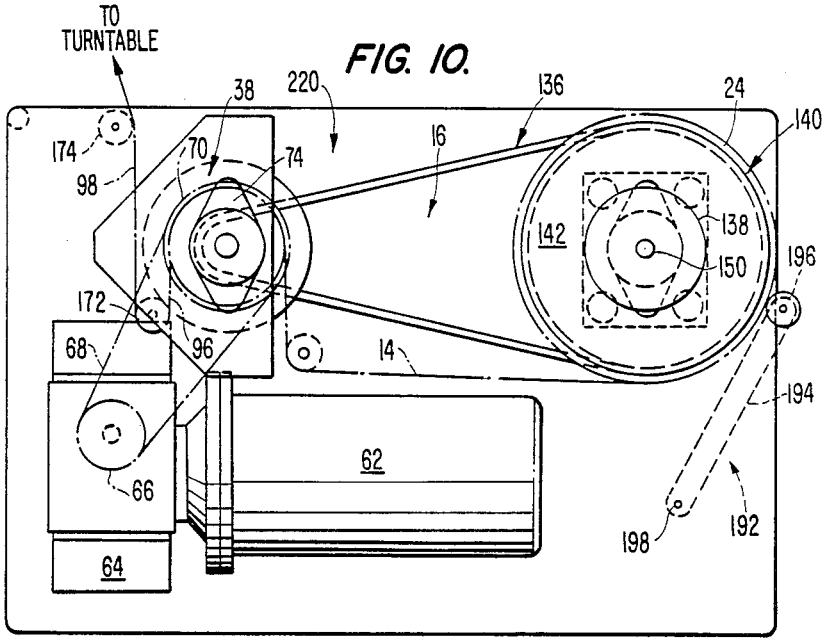
FIG. 10 is a top plan view of an eight embodiment of the present invention.

FIG. 10 illustrates an eight embodiment 220 of the present invention. The difference between the eight embodiment and the sixth embodiment is that the constant tension maintaining mechanism 18 has been omitted and extra idler rollers 172 and 174 have been added. Like reference numerals are used to identify like parts in FIGS. 8 and 10. With the exception of the benefit of isolation provided by constant tension maintaining mechanism 18, the operation of the prestretching unit 16 of the eight embodiment is identical to the sixth embodiment.

Figure 11:
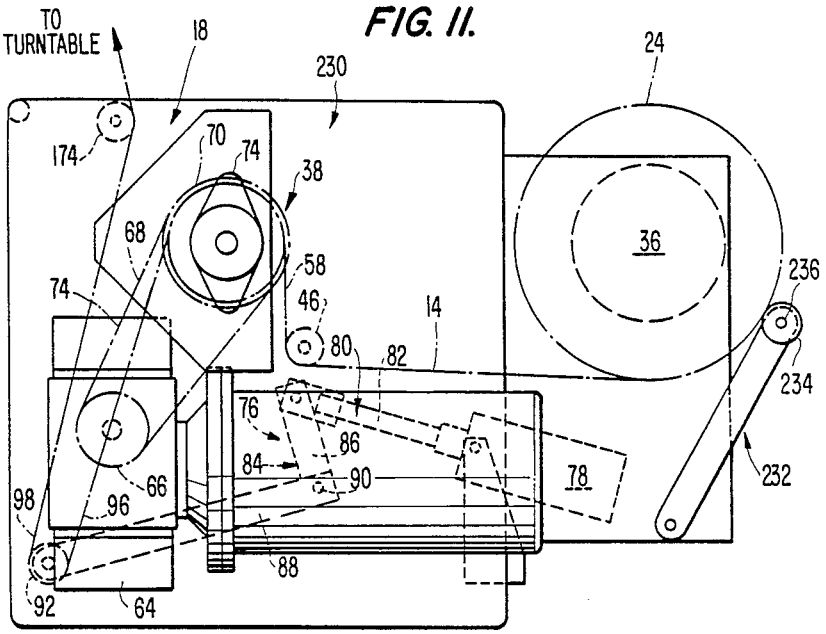
FIG. 11 is a top plan view of a ninth embodiment of the present invention.

FIGS. 11 and 18 illustrate a ninth embodiment 230 of the present invention. Like reference numerals in FIGS. 7 and 11 identify identical parts.

With respect to FIG. 11, a velocity sensor 232, which may be a conventional tachometer, has a rotatably mounted roller 234 which senses the peripheral velocity of the roll of stretchable wrapping material 24 by riding in contact therewith. The rotation of the shaft 236 of roller 234 rotates a velocity signal generator (not illustrated) which produces an output signal. A velocity sensor (element 240 in FIG. 18), which also may be a conventional tachometer, is connected to the shaft driving driven roller 38 which senses the peripheral velocity of the driven roller.

FIG. 18 illustrates the control circuit for the brake 36 of the embodiment illustrated in FIG. 11. The function of the control circuit is to maintain a constant ratio of the peripheral velocity of the driven roller 38 to the peripheral velocity of the supply roll 24. The output signal T1 from the tachometer 232 and the output signal T2 from the tachometer 240 are respectively applied to the inverting and noninverting inputs of a differential amplifier 242 to compute the quantity $T_2-T_1$. The output of differential amplifier 242 is applied to a divider 244 to which is also applied the output signal from the tachometer 232 to compute the quantity $(T_2-T_1)/T_1$ which is a function of the percentage of prestretch. The output from the divider 244 is applied to indicator 246 which displays the percentage of prestretch which is useful for users of the stretch wrapping machine. Differential amplifier 250 compares the quantity $(T_2-T_1)/T_1$ with the set amount of desired prestretch from potentiometer 248 which produces an output signal of zero when the system is in balance (i.e. prestretching at the desired rate) and positive or negative outputs depending on which way the system is out of balance. The output signal from the differential amplifier 250 is applied to brake controller 252 which is an amplifier designed to power the brake 36. When the system is out of balance, the brake 36 is activated to either increase or decrease the braking force to maintain the constant ratio of peripheral velocity of the driven roller 38 to the peripheral velocity of the roll of stretchable wrapping material 24.

Figure 12:
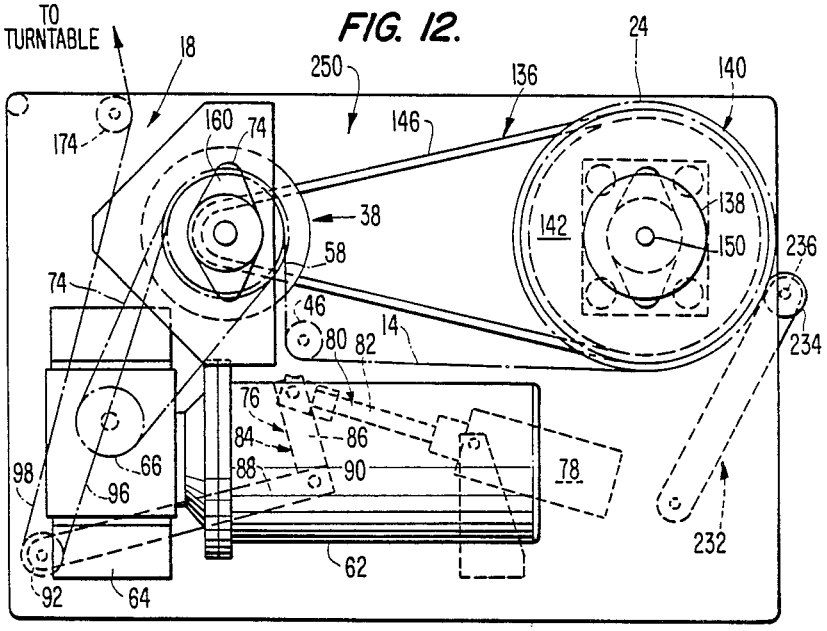
FIG. 12 is a top plan view of a tenth embodiment of the present invention.

FIGS. 12 and 19 illustrate a tenth embodiment 250 of the present invention. Like reference numerals in FIGS. 8 and 12 identify identical parts. The control circuit of FIG. 19 is identical to that described, supra, with reference to FIG. 18 in conjunction with the description of the ninth embodiment, except that the servo motor 138 is being controlled by a servo motor controller 254 which is an amplifier designed to power the servo motor 138. As the prestretcher 16 operates, the differential amplifier 250 produces a signal which causes the servo motor 138 to change the ratio between the rotational speeds of the driven roller 38 and the roll of stretchable wrapping material 24 to maintain the ratio of the peripheral velocities of the driven roller to the roll of stretchable wrapping material substantially constant to produce a set rate of prestretching.

The amount of prestretching (i.e. the % of elongation past the nominal length of the stretchable wrapping material from the roll of stretchable wrapping material 24) is set in the ten embodiments as follows. The first four embodiments set the amount of prestretching by the setting of the regulated air supply associated with the constant force producing element 52. The fifth through eight embodiments set the amount of prestretching by the setting of a potentiometer which controls the ratio of the peripheral velocity of the driven roller 38 to the peripheral velocity of the supply roll 24. The ninth and tenth embodiments control the amount of prestretching by setting the potentiometer 248.

Figure 20:
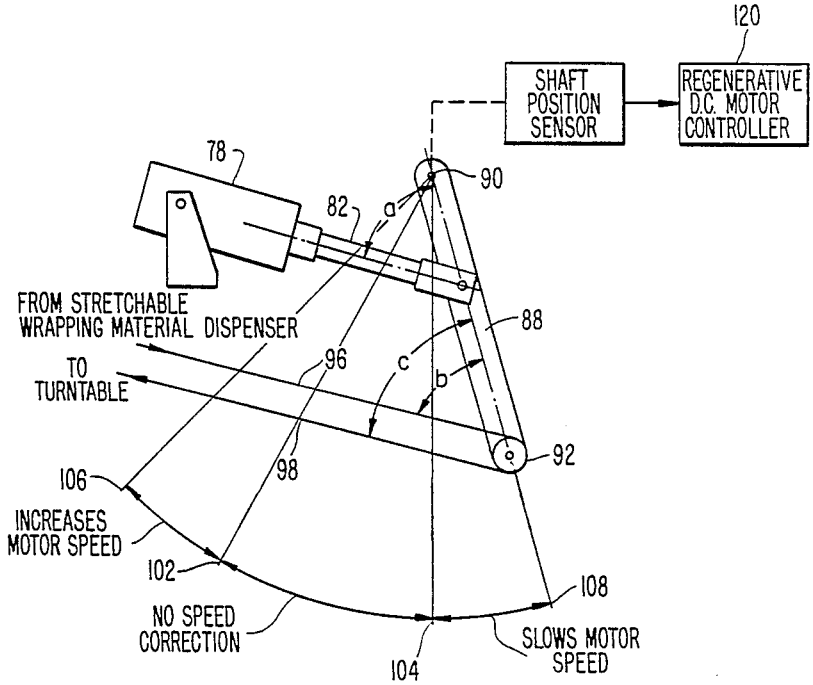
FIG. 20 is an alternative embodiment of a mechanism for producing substantially constant tension producing which may be used in the first, second, fifth, sixth, ninth and tenth embodiments.

FIG. 20 illustrates an alternative embodiment of the mechanism for producing substantially constant wrapping tension to that illustrated in FIG. 17. Like reference numerals illustrate like parts in FIGS. 17 and 20. The difference between the embodiments of FIGS. 17 and 20 is that the constant force producing mechanism is attached directly to arm 88 to counter the force applied to the tension roller 92 by stretchable wrapping material. The theory of operation for both embodiments is identical. The length of the arm between the attachment point to arm 88 and the pivot point of arm 88 is treated as length of the section 86 in the analysis in FIG. 16. Alternatively the pivot point 90 may be located intermediate the ends of the arm 88 with the extensible arm 80 pivotably attached to the end of arm 88 opposite tension roller 92 as with the dancer 42 of the first four embodiments.

While the invention has been described in terms of its preferred embodiments, it should be understood that numerous modifications may be made thereto without departing from the spirit and scope of the invention. It is intended that all such modifications fall within the scope of the appended claims.

I claim:

1. A wrapping machine for wrapping with substantially constant tension a load placed on a rotatable turntable with a stretchable wrapping material comprising:

a prestretcher for stretching the wrapping material prior to wrapping around the load;

rotatable holding means for holding a roll of stretchable wrapping material which supplies the wrapping material to be wrapped around the load;

braking means coupled to the rotatable holding means for applying a braking force to the holding means in accordance with a brake control signal applied thereto to cause the film disposed on the roll to be restrained;

a single driven roller disposed between the roll of stretchable wrapping material and the turntable which contacts the stretchable wrapping material for applying a force to the stretchable wrapping material to cause prestretching and for changing the velocity of the stretchable wrapping material being delivered to the load to maintain substantially constant wrapping tension;

a variable speed electric motor for rotating the single driven roller to cause prestretching of the stretchable wrapping material disposed between the roll of stretchable wrapping material and the driven roller;

means for generating the brake control signal, the brake control signal being applied to the braking means to control the prestretching of the stretchable wrapping material, the brake control signal being a function of the supply of film from the roll of stretchable wrapping material;

means for maintaining substantially constant tension on the stretchable wrapping material being wrapped around the load disposed between the driven roller and the turntable which controls the speed of the variable speed electric motor as a function of velocity sensed during wrapping of the stretchable wrapping material located between the driven roller and the turntable by a velocity sensing means; and means for selecting the amount of prestretching.

2. A wrapping machine in accordance with claim 1 wherein:

the means for selecting the amount of prestretching varies the brake control signal to vary the braking force.

3. A wrapping machine in accordance with claim 1 wherein the means for generating the brake control signal comprises:

means for sensing change in outside diameter of the roll of stretchable wrapping material and for generating the brake control signal as a function of the change in diameter.

4. A wrapping machine in accordance with claim 1 wherein said means for maintaining a substantially constant tension comprises:

a first arm pivotably mounted for rotation around a fixed point through a path of rotation;

a first roller rotatably mounted on the first arm at a point offset from the fixed point, the first roller engaging the stretchable wrapping material to define a path of approach of the stretchable wrapping material between the driven roller and the first roller;

a second roller rotatably mounted at a point between the first roller and the turntable which engages the stretchable wrapping material during wrapping of the load and which defines a path of departure of the stretchable wrapping material between the first roller and the second roller;

the first arm defining a first angle with the path of approach of the stretchable wrapping material and a second angle with the path of departure of the stretchable wrapping material, the first and second angles being substantially equal within the path of rotation and varying with rotation of the arm through the path of rotation;

a second arm pivoted about the fixed point which is connected to the first arm; and means for applying a constant force to the second arm at a point offset from the pivot point which opposes a force applied to the first arm by tension on the wrapping material in the paths of approach and departure, the second arm and the means for applying a constant force defining a third angle which is substantially equal to the first and second angles within the path of rotation of the first arm.

5. A wrapping machine in accordance with claim 4 wherein:

the first arm has a longitudinal axis which is not parallel with a longitudinal axis of the second arm.

6. A wrapping machine in accordance with claim 4 further comprising:

means for sensing an increase in the velocity of the stretchable wrapping material being wrapped around the load;

means for sensing a decrease in the velocity of the load stretchable wrapping material being wrapped around the load; and control means, coupled to the variable speed electric motor, which is responsive to the means for sensing an increase in the velocity of the stretchable wrapping material to increase the rate of rotation of the driven roller to increase the velocity of stretchable wrapping material being fed and which is responsive to the means for sensing a decrease in the velocity of the stretchable wrapping to decrease the rate of rotation of the driven roller to decrease the velocity of stretchable wrapping material being fed.

7. A wrapping machine in accordance with claim 4 further comprising:

means for sensing when the first arm moves past a first angular limit at a boundary of a first control zone into a second control zone within the path of rotation that is caused by an increase in the velocity of stretchable wrapping material being wrapped around the load;

means for sensing when the first arm moves past a second angular limit at a boundary of the first control zone into a third control zone within the path of rotation that is caused by a decrease in the velocity of the stretchable wrapping material being wrapped around the load; and control means, coupled to the variable speed electric motor, for increasing the rate of rotation of the driven roller to increase the velocity of the stretchable wrapping material fed in response to the means for sensing when the first arm moves past the first angular limit into the second control zone, for decreasing the rate of rotation of the driven roller to decrease the velocity of the stretchable wrapping material fed in response to the means for sensing when the first arm moves past the second angular limit into the third control zone, and for maintaining the rate of rotation of the driven roller substantially constant as long as the first arm is within the first zone.

8. A wrapping machine in accordance with claim 7 wherein:

the driven roller feeds the stretchable wrapping material with an increasing velocity as long as the first arm is within the second control zone and feeds the stretchable wrapping material with a decreasing velocity as long as the first arm is within the third control zone.

9. A wrapping machine in accordance with claim 2 wherein said means for maintaining a substantially constant tension comprises:

a first arm pivotably mounted for rotation around a fixed point through a path of rotation;

a first roller rotatably mounted on the first arm at a point offset from the fixed point, the first roller engaging the stretchable wrapping material to define a path of approach of the stretchable wrapping material between the driven roller and the first roller;

a second roller rotatably mounted at a point between the first roller and the turntable which engages the stretchable wrapping material during wrapping of the load and which defines a path of departure of the stretchable wrapping material between the first roller and the second roller;

the first arm defining a first angle with the path of approach of the stretchable wrapping material and a second angle with the path of departure of the stretchable wrapping material, the first and second angles being substantially equal within the path of rotation and varying with rotation of the arm through the path of rotation;

a second arm pivoted about the fixed point which is connected to the first arm; and means for applying a constant force to the second arm at a point offset from the pivot point which opposes a force applied to the first arm by tension on the wrapping material in the paths of approach and departure, the second arm and the means for applying a constant force defining a third angle which is substantially equal to the first and second angles within the path of rotation of the first arm.

10. A wrapping machine in accordance with claim 9 wherein:

the first arm has a longitudinal axis which is not parallel with a longitudinal axis of the second arm.

11. A wrapping machine in accordance with claim 9 further comprising:

means for sensing an increase in the velocity of the stretchable wrapping material being wrapped around the load;

means for sensing a decrease in the velocity of the stretchable wrapping material being wrapped around the load; and control means, coupled to the variable speed electric motor, which is responsive to the means for sensing an increase in the velocity of the stretchable wrapping material to increase the rate of rotation of the driven roller to increase the velocity of stretchable wrapping material being fed and which is responsive to the means for sensing a decrease in the velocity of the stretchable wrapping to decrease the rate of rotation of the driven roller to decrease the velocity of stretchable wrapping material being fed.

12. A wrapping machine in accordance with claim 9 further comprising:

means for sensing when the first arm moves past a first angular limit at a boundary of a first control zone into a second control zone within the path of rotation that is caused by an increase in the velocity of the stretchable wrapping material being wrapped around the load;

means for sensing when the first arm moves past a second angular limit at a boundary of the first control zone into a third control zone within the path of rotation that is caused by a decrease in the velocity of the stretchable wrapping material being wrapped around the load; and control means, coupled to the variable speed electric motor, for increasing the rate of rotation of the driven roller to increase the velocity of the stretchable wrapping material fed in response to the means for sensing when the first arm moves past the first angular limit into the second control zone, for decreasing the rate of rotation of the driven roller to decrease the velocity of the stretchable wrapping material fed in response to the means for sensing when the first arm moves past the second angular limit into the third control zone, and for maintaining the rate of rotation of the driven roller substantially constant as long as the first arm is within the first zone.

13. A wrapping machine in accordance with claim 12, wherein:

the driven roller feeds the stretchable wrapping material with an increasing velocity as long as the first arm is within the second control zone and feeds the stretchable wrapping material with a decreasing velocity as long as the firm arm is within the third control zone.

14. A wrapping machine in accordance with claim 3 wherein said means for maintaining a substantially constant tension comprises:

a first arm pivotably mounted for rotation around a fixed point through a path of rotation;

a first roller rotatably mounted on the first arm at a point offset from the fixed point, the first roller engaging the stretchable wrapping material to define a path of approach of the stretchable wrapping material between the driven roller and the first roller;

a second roller rotatably mounted at a point between the first roller and the turntable which engages the stretchable wrapping material during wrapping of the load and which defines a path of departure of the stretchable wrapping material between the first roller and the second roller;

the first arm defining a first angle with the path of approach of the stretchable wrapping material and a second angle with the path of departure of the stretchable wrapping material, the first and second angles being substantially equal within the path of rotation and varying with rotation of the arm through the path of rotation;

a second arm pivoted about the fixed point which is connected to the first arm; and means for applying a constant force to the second arm at a point offset from the pivot point which opposes a force applied to the first arm by tension on the wrapping material in the paths of approach and departure, the second arm and the means for applying a constant force defining a third angle which is substantially equal to the first and second angles within the path of rotation of the first arm.

15. A wrapping machine in accordance with claim 14 wherein the first arm has a longitudinal axis which is not parallel with a longitudinal axis of the second arm.

16. A wrapping machine in accordance with claim 5 further comprising:

means for sensing an increase in the velocity of the stretchable wrapping material being wrapped around the load;

means for sensing a decrease in the velocity of the stretchable wrapping material being wrapped around the load; and control means, coupled to the variable speed electric motor, which is responsive to the means for sensing an increase in the velocity of the stretchable wrapping material to increase the rate of rotation of the driven roller to increase the velocity of stretchable wrapping material being fed and which is responsive to the means for sensing a decrease the rate of rotation of the driven roller to decrease the velocity of the stretchable wrapping material being fed.

17. A wrapping machine in accordance with claim 14 further comprising:

means for sensing when the first arm moves past a first angular limit at a boundary of a first control zone into a second control zone within the path of rotation that is caused by an increase in the velocity of the stretchable wrapping material being wrapped around the load;

means for sensing when the first arm moves past a second angular limit at a boundary of the first control zone into a third control zone within the path of rotation that is caused by a decrease in the velocity of the stretchable wrapping material being wrapped around the load; and control means, coupled to the variable speed electric motor, for increasing the rate of rotation of the driven roller to increase the velocity of the stretchable wrapping material fed in response to the means for sensing when the first arm moves past the first angular limit into the second control zone, for decreasing the rate of rotation of the driven roller to decrease the velocity of the stretchable wrapping material fed in response to the means for sensing when the first arm moves past the second angular limit into the third control zone, and for maintaining the rate of rotation of the driven roller substantially constant as long as the first arm is within the first zone.

18. A wrapping machine in accordance with the claim 17 wherein:

the driven roller feeds the stretchable wrapping material with an increasing velocity as long as the first arm is within the second control zone and feeds the stretchable wrapping material with a decreasing velocity as long as the first arm is within the third control zone.

19. A wrapping machine in accordance with claim 1 wherein:

the means for generating the brake control signal generates the brake control signal as a function of a ratio of peripheral velocity of the roll and a speed of rotation of the driven roller.

20. A wrapping machine in accordance with claim 19 wherein the means for generating the brake control signal comprises:

first velocity sensing means for sensing a peripheral velocity of the roll of stretchable wrapping material and for generating a first signal representative of the sensed peripheral velocity of the roll of stretchable wrapping material;

a second velocity sensing means for sensing a speed of rotation of the driven roller and for generating a second signal representative of the speed of rotation of the driven roller; and a controller, responsive to the first and second signals, for generating the brake control signal.

21. A wrapping machine in accordance with claim 20 wherein:

the controller is also responsive to the selected amount of prestretching.

22. A wrapping machine in accordance with claim 21 wherein the controller comprises:

means for calculating a ratio which is a function of the peripheral velocity of the driven roller divided by a function of the peripheral velocity of the roll of stretchable wrapping material; and a comparison means, coupled to the means for calculating and to the means for setting an amount of prestretching, for comparing the ratio with the set amount of prestretching to produce the brake control signal with the brake control signal not varying when the ratio and set amount are equal, and varying with a difference between the ratio and the set amount of prestretching.

23. A wrapping machine in accordance with claim 22 wherein said means for maintaining a substantially constant tension comprises:

a first arm pivotably mounted for rotation around a fixed point through a path of rotation;

a first roller rotatably mounted on the first arm at a point offset from the fixed point, the first roller engaging the stretchable wrapping material to define a path of approach of the stretchable wrapping material between the driven roller and the first roller;

a second roller rotatably mounted at a point between the first roller and the turntable which engages the stretchable wrapping material during wrapping of the load and which defines a path of departure of the stretchable wrapping material between the first roller and the second roller;

the first arm defining a first angle with the path of approach of the stretchable wrapping material and a second angle with the path of departure of the stretchable wrapping material, the first and second angles being substantially equal within the path of rotation and varying with rotation of the arm through the path of rotation;

a second arm pivoted about the fixed point which is connected to the first arm; and means for applying a constant force to the second arm at a point offset from the pivot point which opposes a force applied to the first arm by tension on the wrapping material in the paths of approach and departure, the second arm and the means for applying a constant force defining a third angle which is substantially equal to the first and second angles within the path of rotation of the first arm.

24. A wrapping machine in accordance with claim 23 wherein:

the first arm has a longitudinal axis which is not parallel with a longitudinal axis of the second arm.

25. A wrapping machine in accordance with claim 23 further comprising:

means for sensing an increase in the velocity of the stretchable wrapping material being wrapped around the load;

means for sensing a decrease in the velocity of the stretchable wrapping material being wrapped around the load; and control means, coupled to the variable speed electric motor, which is responsive to the means for sensing an increase in the velocity of the stretchable wrapping material to increase the rate of rotation of the driven roller to increase the velocity of stretchable wrapping material being fed and which is responsive to the means for sensing a decrease in the velocity of the stretchable wrapping to decrease the rate of rotation of the driven roller to decrease the velocity of stretchable wrapping material being fed.

26. A wrapping machine in accordance with claim 23 further comprising:

means for sensing when the first arm moves past a first angular limit at a boundary of a first control zone into a second control zone within the path of rotation that is caused by an increase in the velocity of the stretchable wrapping material being wrapped around the load;

means for sensing when the first arm moves past a second angular limit at a boundary of the first control zone into a third control zone within the path of rotation that is caused by a decrease in the velocity of the stretchable wrapping material being wrapped around the load; and control means, coupled to the variable speed electric motor, for increasing the rate of rotation of the driven roller to increase the velocity of the stretchable wrapping material fed in response to the means for sensing when the first arm moves past the first angular limit into the second control zone, for decreasing the rate of rotation of the driven roller to decrease the velocity of the stretchable wrapping material fed in response to the means for sensing when the first arm moves past the second angular limit into the third control zone, and for maintaining the rate of rotation of the driven roller substantially constant as long as the first arm is within the first zone.

27. A wrapping machine in accordance with claim 26 wherein:

the driven roller feeds the stretchable wrapping material with an increasing velocity as long as the first arm is within the second control zone and feeds the stretchable wrapping material with a decreasing velocity as long as the first arm is within the third control zone.

* * * * *